US005983529A

United States Patent [19]

Serna

[11] Patent Number: 5,983,529

[45] Date of Patent: Nov. 16, 1999

[54] FOOTWEAR SHOCK ABSORBING SYSTEM

[75] Inventor: Ralph Serna, Long Beach, Calif.

[73] Assignee: Vans, Inc., Santa Fe Springs, Calif.

[21] Appl. No.: 08/904,413

[22] Filed: Jul. 31, 1997

[51] Int. Cl.[6] ..... A43B 13/18

[52] U.S. Cl. ..... 36/28; 36/37

[58] Field of Search ..... 36/28, 29, 35 R, 36/37, 35 B, 43, 102

[56] References Cited

U.S. PATENT DOCUMENTS

| | | | |
|---|---|---|---|
| 825,515 | 7/1906 | Byrne et al. . | |
| 1,781,715 | 11/1930 | Blakely . | |
| 4,449,306 | 5/1984 | Cavanagh . | |
| 4,535,553 | 8/1985 | Derderian et al. . | |
| 4,704,808 | 11/1987 | Bianchini et al. | 36/102 |
| 4,733,483 | 3/1988 | Lin | 36/28 |
| 4,815,221 | 3/1989 | Diaz . | |
| 4,817,304 | 4/1989 | Parker et al. . | |
| 4,881,329 | 11/1989 | Crowley . | |
| 5,086,574 | 2/1992 | Bacchiocchi . | |
| 5,092,060 | 3/1992 | Frachey et al. . | |
| 5,255,451 | 10/1993 | Tong et al. . | |
| 5,311,674 | 5/1994 | Santiyanont et al. . | |
| 5,343,639 | 9/1994 | Kilgore et al. . | |
| 5,353,523 | 10/1994 | Kilgore et al. . | |
| 5,369,896 | 12/1994 | Frachey et al. | 36/28 |
| 5,469,639 | 11/1995 | Sessa | 36/28 |
| 5,544,429 | 8/1996 | Ellis, III . | |
| 5,544,431 | 8/1996 | Dixon . | |
| 5,561,920 | 10/1996 | Graham et al. . | |
| 5,575,088 | 11/1996 | Allen et al. | 36/28 |
| 5,718,063 | 2/1998 | Yamashita et al. . | |
| 5,771,606 | 6/1998 | Litchfield et al. | 36/28 |
| 5,815,949 | 10/1998 | Sessa | 36/28 |

*Primary Examiner*—M. D. Patterson
*Attorney, Agent, or Firm*—Fish & Richardson P.C.

[57] ABSTRACT

A shock absorbing cassette for the midsole of an article of footwear is described. The shock absorbing cassette has a cassette base, first and second sets of cushion elements, and a reduced height cushion element in between the first and second sets of cushion elements. The cushion elements are arranged to cushion the heel of the foot. The shock absorbing cassette may be part of a shoe sole shock absorbing system that also includes an insole board having forefoot slits to improve flexing, a thin midsole with a heel pocket for seating the cassette, and a durable outsole.

25 Claims, 9 Drawing Sheets

3E,3F
30

16
35
34
3D
32
37
3D
37
36
36
32
3B,3C
3B,3C
38
3E,3F

FOOTWEAR SHOCK ABSORBING SYSTEM

BACKGROUND OF THE INVENTION

This invention relates to footwear having a shock absorbing system. In particular, a shock absorbing cassette provides improved heel cushioning and stability in a shoe.

Modern athletic shoes combine many elements having specific functions that work together to support and protect the foot. Footwear manufacturers make tennis shoes, basketball shoes, running shoes, baseball shoes, football shoes, weightlifting shoes, and walking shoes for use in those specific sport activities. Each shoe type provides a specific combination of traction, support and protection for the foot to enhance performance.

FIG. 4 is a representation of the skeletal framework 50 of the human foot, which provides the requisite strength to support the weight of the body during many activities. The foot consists of 26 interconnected bones, categorized into three main groups: the phalanges 52 (the distal group), the metatarsus 62 (the middle group), and the tarsus 72 (the posterior group). Although many of the joints between these bones are attached by ligaments and are thus relatively inflexible, there are a number of movable joints that are important to foot flexibility and stability.

The leg bones (the tibia and fibula, not shown) are movably connected to the talus 77 of the foot to form the ankle joint. The hinge-type joint formed by these bones allows both dorsi flexion (upward movement) and plantar flexion (downward movement) of the foot. The talus 77 overlies and is movably interconnected to the calcaneus 78 (heel bone) to form the subtalar joint, which enables the foot to move in a generally rotative, side-to-side motion. The outward and inward motion of the foot during walking or running is associated with this movement about the subtalar joint.

The metatarsus 62 is comprised of metatarsals 63–67 which are relatively long bones that extend forwardly across the middle part of the foot, articulating the tarsus 72 and phalanges 52. Each of the metatarsals are aligned with and articulate to one of the phalanges. For example, the first metatarsal 63 has a metatarsal head 63*a* which articulates to the hallux (or big toe) at the proximal phalange of the hallux 53*a*, and the fifth metatarsal 67 has a metatarsal head 67*a* which articulates to the proximal phalanx 57*a* of the fifth or smallest digit. The first, second and third metatarsals 63–65 are attached at their proximal ends to the outer, middle and inner cuneiforms 73–75, respectively. The proximal ends of the fourth and fifth metatarsals 66,67 articulate to the cuboid 76.

The phalanges 52 comprise fourteen bones 53*a*–57*c* which are associated with the toes, and are hingedly attached to the metatarsals 63–67 for significant movement. The hallux 53 or big toe is the prominent toe for supporting weight, providing propulsive force and for stabilizing the foot. The movements of these bones in the foot play an integral role in controlling pronation and supination of the foot.

A shoe is divided into two general parts, an upper and a sole. The upper is designed to comfortably enclose the foot, while the sole provides traction, protection and a durable wear surface. It is desirable to provide the sole with enhanced protection and cushioning for the foot and leg. Accordingly, the sole of a running shoe typically includes several layers, including a resilient shock absorbing or cushioning layer as a midsole and a ground contacting outer sole or outsole which provides both durability and traction.

The sole also provides a broad, stable base to support the foot during ground contact.

Different materials in different configurations have been used in the midsole to improve cushioning and to provide effective foot control. Some shoes use materials of different hardness to provide cushioning and foot control. However, many shoes use only ethyl vinyl acetate (EVA) for cushioning. The cells of this foam tends to break down during use, virtually eliminating the usefulness of the midsole over time.

Although many different types of shoes have been designed for specific sports activities, there apparently has never been a shoe designed for the sport of skateboarding. A skateboarding shoe should have a thin midsole so that a skateboarder can "feel" the board during riding, and when using various footwork positions to perform stunts, in order to maintain better control of the movements of the skateboard. In addition, the shoe must provide adequate cushioning to prevent heel bruising when a skateboarder performs a jump maneuver and lands on the skateboard, the pavement or on some other hard surface.

SUMMARY OF THE INVENTION

The invention concerns a shoe sole shock absorbing system, and features a shock absorbing cassette for the midsole. In particular, a skateboard rider requires a shoe having a thin sole so that he can get "board feel" through the soles to his feet. The "board feel" enables the skateboarder to better control the skateboard. However, because skateboarders perform many jump maneuvers from ramps, railings and the like, which may vary in height from three to fifteen feet, heel bruising from the impact has been a problem. Thus, the present invention provides a thin shock absorbing cassette for a shoe sole to minimize heel bruising, and provides other sole features for the sport of skateboarding which are described below.

In one aspect, generally, a shock absorbing cassette according to the invention comprises a cassette base, first and second sets of deformable cushion elements having a wide base and a narrower tip attached to the cassette base, and a reduced height cushion element having a wide base and a narrower tip attached to the cassette base in between the first and second sets of cushion elements. The cushion elements may be shaped like truncated cones, or be hemispherically shaped. The first and second sets of cushion elements may be of equal height. The shock absorbing cassette may be manufactured by forming the cassette base and cushion elements and then attaching the first set of cushion elements to the front of the cassette base, attaching the second set of cushion elements to the rear of the cassette base and attaching the reduced height cushion element to the cassette base in between the first and second sets of cushion elements. The cassette base and cushion elements may be made of polyurethane, wherein the polyurethane may be in the range of 57 to 68 durometers. The cushion elements may also be made of other materials, such as Sorbathane™.

In another aspect, a shoe sole shock absorbing system and method of manufacture is disclosed. An insole board having a plurality of forefoot slits to improve forefoot flexing is included. A midsole is attached to the insole board and has a thin forefoot section and a heel pocket. A shock absorbing cassette fits into the heel pocket, and a flexible outsole is attached to the midsole and shock absorbing cassette. The insole board may have star-shaped heel cuts to improve cushioning. The shock absorbing cassette may include a cassette base, first and second sets of cushion elements and a reduced height cushion element. The first and second sets of cushion elements may be of the same height, and each of the cushion elements may be shaped like truncated cones or may be hemispherically shaped. The lateral side of the outsole and midsole may have an enhanced radius to improve foot control of a skateboarder, and the radius may be in the range of 7 to 18 degrees.

In another aspect, a shock absorbing system for a skateboard shoe is disclosed. An insole board having a plurality of forefoot slits is attached to a midsole. The midsole has a thin forefoot section and a heel pocket. A shock absorbing cassette comprising a cassette base and a plurality of cushion elements is attached to the heel pocket. An outsole is connected to the midsole and to the shock absorbing cassette, and the outsole has a lateral side having an enhanced radius which may be in the range of 7 to 18 degrees. A toe guard may be attached to the outsole. In addition, the insole board may have a plurality of heel cuts to improve cushioning. Also, the outsole heel portion may have a curvature of 25 degrees and the outsole toe portion may have a curvature of 45 degrees.

The details of one or more embodiments of the invention are set forth in the accompanying drawings and the description below. Other features, objects, and advantages of the invention will be apparent from the description and drawings, and from the claims.

DETAILED DESCRIPTION

Figure 1A:
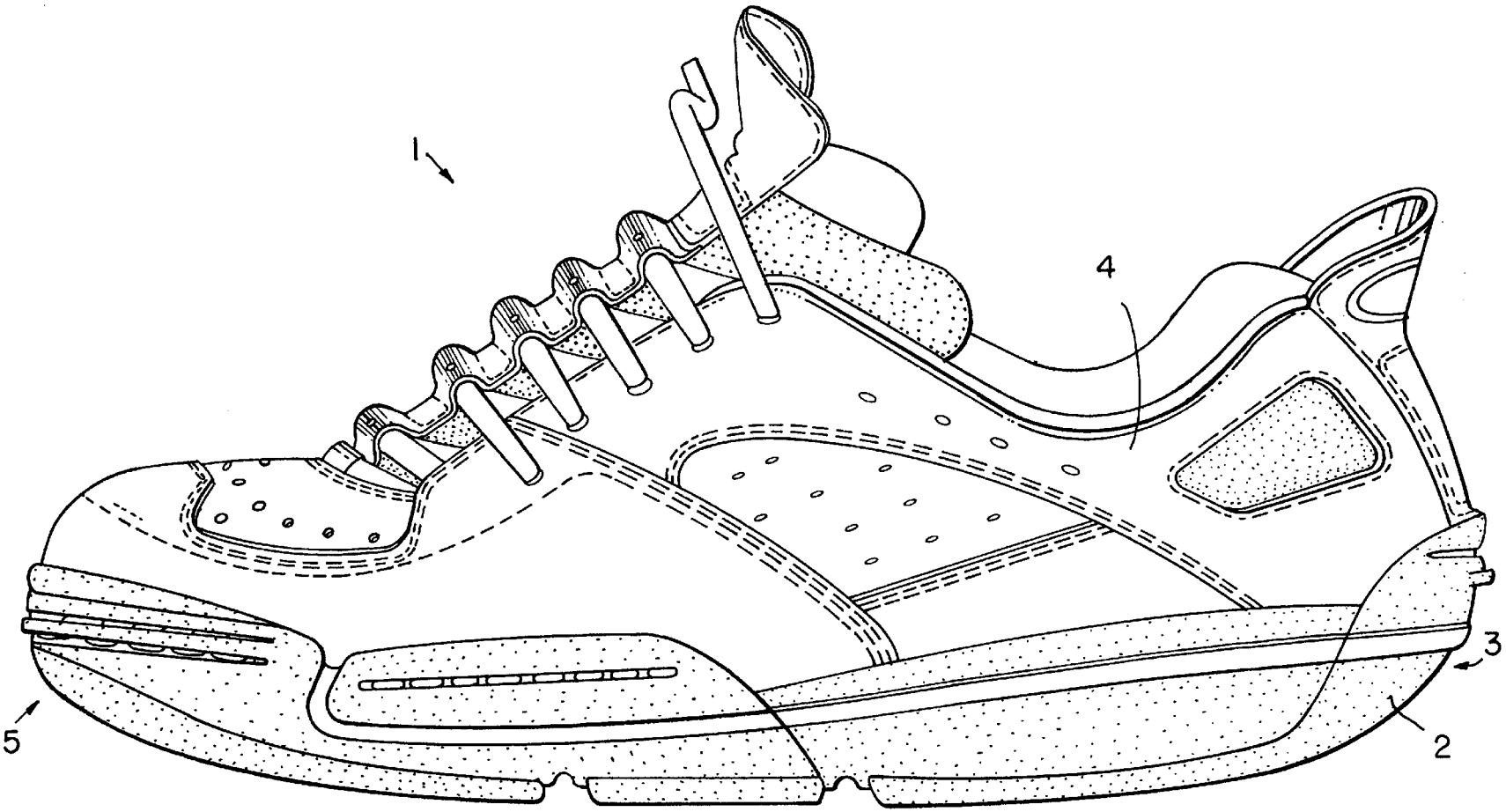
FIG. 1A is a side view of a shoe of a type that may incorporate the cushioning system according to the invention.

FIG. 1A is a side view of a skateboard shoe 1 of a type that could incorporate the cushioning system of the present invention. The skateboard shoe includes a sole 2 and an upper 4 which may be of any conventional design attached to it. The sole 2 incorporates novel features that are explained below, and has a heel curvature 3 and a toe curvature 5 which will also be explained below.

A skateboard shoe 1 is shown in the drawings for illustrative purposes only. Other footwear, such as mountain bike shoes, snowboard boots and the like, could incorporate the novel sole features described below. It should also be understood that the drawings are not drawn to scale, and for ease of reference like elements have been numbered the same in the various drawings.

Figure 1B:
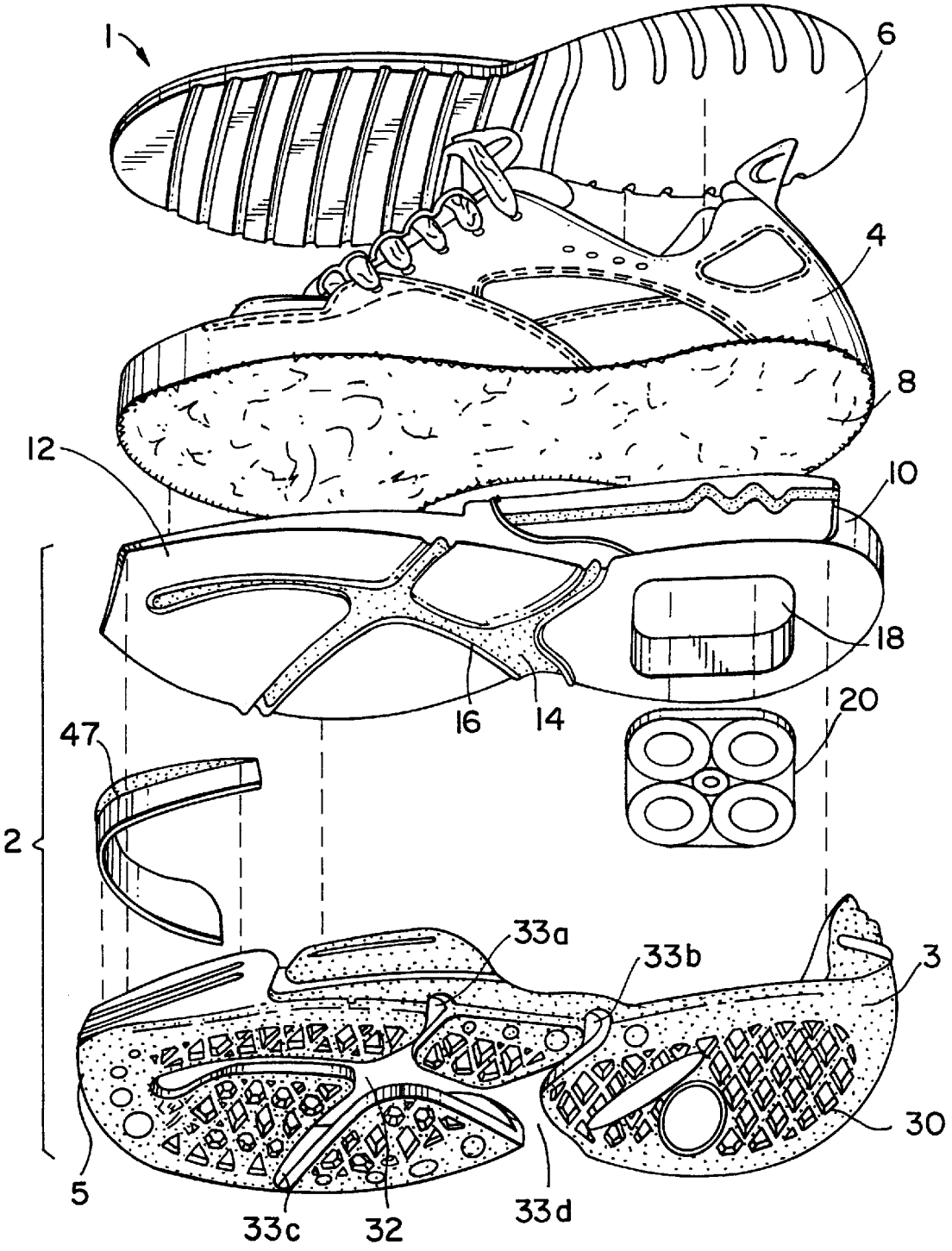
FIG. 1B is an exploded, perspective view of the shoe of FIG. 1A.

FIG. 1B is an exploded, perspective view of the skateboard shoe 1 of FIG. 1A. An insole 6, for cradling a wearer's foot fits within the upper 4. The insole 6 conventionally comprises a thin layer of tricot or other soft material. The insole 6 is shaped to generally conform to the shape of the bottom of the foot, and cups the bottom of the wearer's foot when the shoe is being worn. The upper is attached to a woven or non-woven insole board 8 which helps the upper retain its shape.

The sole 2 comprises a midsole 10, shock absorbing cassette 20, outsole 30 and toe guard 47. The midsole 10 has a thin forefoot section 12 and grooves 14 to provide flexibility in this region of the foot. Formed about the outside edges of the grooves 14 is a lip or raised area 16. The midsole also contains a heel pocket 18 that is shaped to receive the shock absorbing cassette 20. The midsole is preferably made of a compression molded ethyl vinyl acetate (CMEVA), which is more durable than a conventional EVA material. A toe guard 47 attaches to the outsole, and lastly an outsole 30 attaches to the midsole. The outsole has open areas or channels 32 that correspond to the grooves 14 and accept the lip 16 of the midsole 10. The outsole 30 is shown having several openings or discontinuities 33*a*, 33*b*, 33*c* and 33*d* about its bottom outside edge; however, the outside edges of the outsole (both lateral and medial sides) could be continuous. The midsole, shock absorbing cassette, toe guard and outsole may be bonded together using known techniques such as gluing or molding.

Figure 1C:
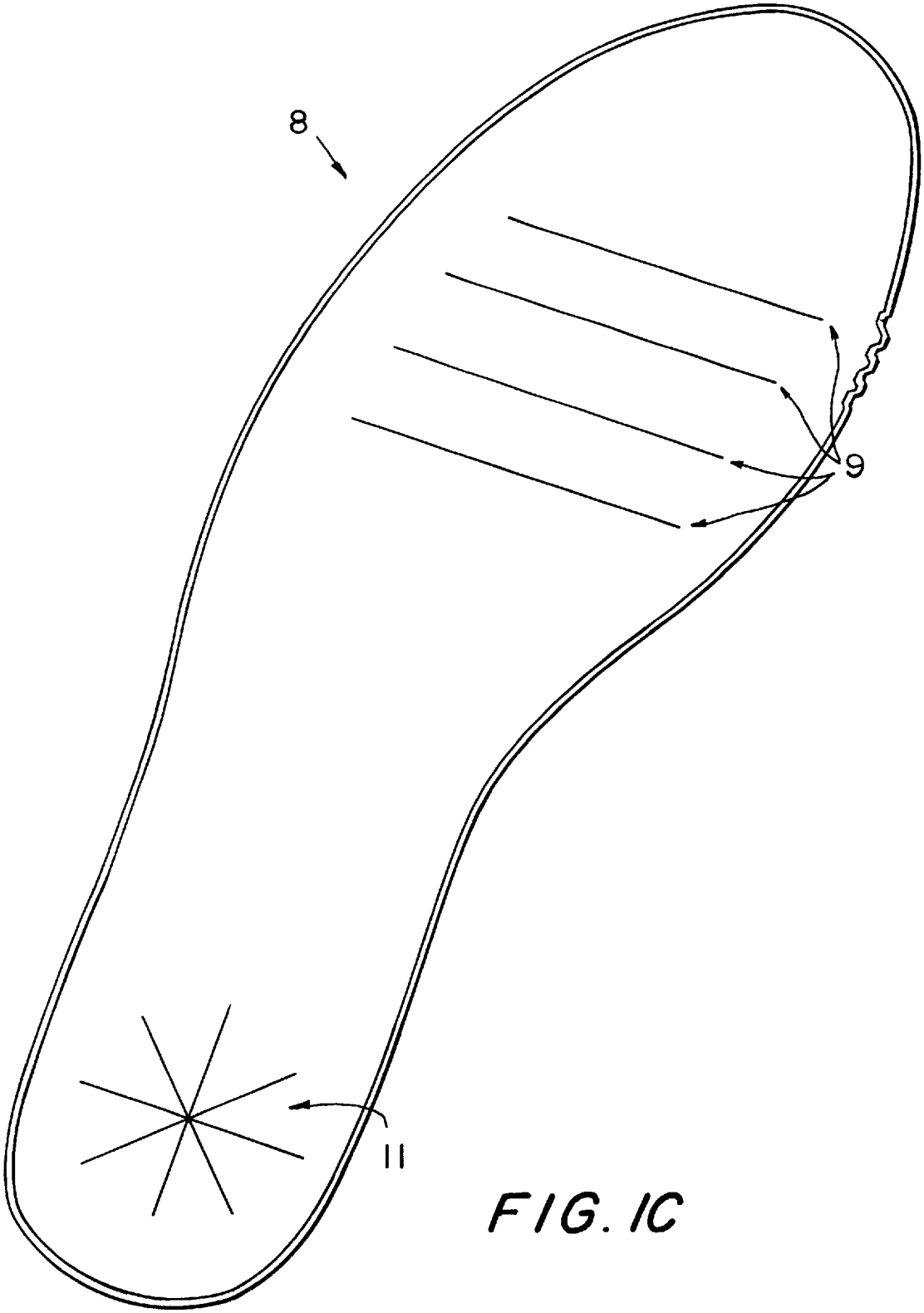
FIG. 1C is a plan view of an insole board.

FIG. 1C is a plan view of an insole board 8 to which the upper 4 of FIG. 1B may be attached. The insole board is preferably made of a stiff, non-woven material that is approximately 1 to 1.5 mm thick; however, the insole board could be thicker or made from some other material. Forefoot slits 9 and star-shaped heel cuts 11 are shown cut entirely through the insole board, but may be cut to a lesser depth. The forefoot slits and star-shaped heel cuts are approximately 1 mm wide and serve to improve the flexing characteristics of the insole board. However, the slits and cuts could be in the range of 0.6 mm to 1.5 mm wide, and could be longer or shorter than illustrated, and could be more or less in number and be of other shapes. The slits and cuts should not be so wide that glue or other bonding material will seep through to the upper during manufacture of the shoe, or so wide that the board looses too much of its resiliency.

A computerized system was used to generate forefoot flexing data by measuring the amount of force in pounds required to flex the forefoot of a shoe to 45 degrees. A shoe containing an insole board having the described forefoot slits required 24 percent less force to bend to the 45 degree angle than a shoe having a solid insole board of the same thickness and material. Similarly, a computerized gravity-driven impact system, which conforms to American Society of Testing Materials (ASTM) standards for footwear, was used to provide force deformation data. The test method was based on peak forces generated at heel strike during foot movement. Test results of a shoe containing an insole board having star-shaped heel cuts showed that cushioning in the heel area could be improved by approximately three percent over a shoe having a solid insole board of the same material and thickness.

Figure 2A:
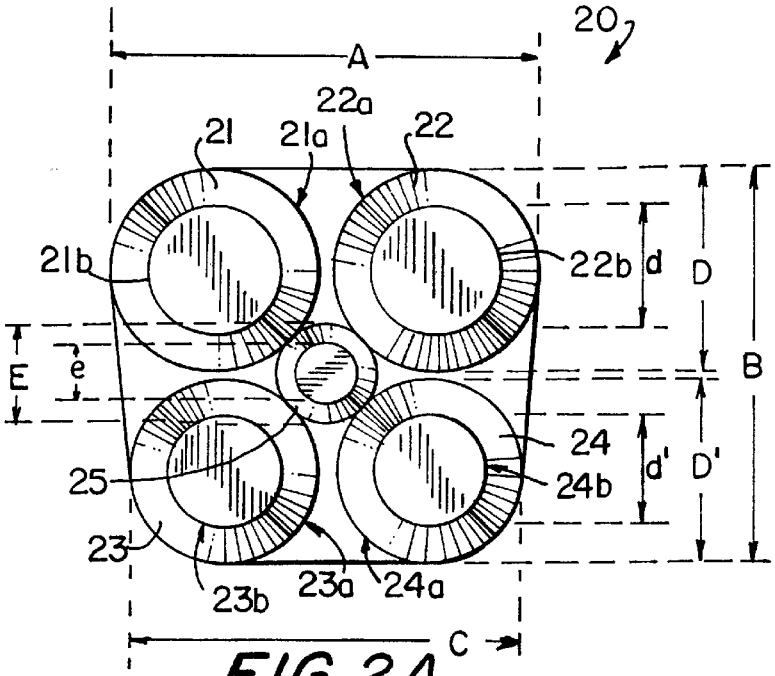
FIGS. 2A and 2B are top and side views, respectively, of an embodiment of a shock absorbing cassette.
Figure 2B:
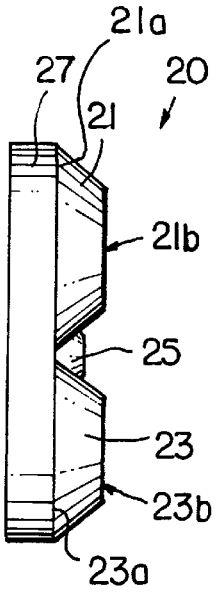

FIGS. 2A and 2B are top and side views, respectively, of an embodiment of a shock absorbing cassette 20. The shock absorbing cassette contains five cushion elements 21 to 25. A first set of cushion elements 21, 22, a second set of cushion elements 23, 24 and a reduced-height central cushion element 25 all have a truncated-cone shape. The truncated cone-shaped cushion elements do not come to a point, but have a flat tip area, and are attached to a cassette base 27. The first set of cushion elements 21, 22 are connected to the forward part of the cassette base 27, which is closest to the forefoot area 12 of the sole when in place in heel pocket 18 (see FIG. 1B), and the second set of cushion elements 23, 24 are connected to the rear part of the cassette base 27. In the embodiment shown, the first set of cushion elements have base portions 21*a*, 22*a* having a diameter D of approximately 27 mm, and tip areas 21*b*, 22*b* having a diameter d of approximately 17 mm. The second set of cushion elements have base portions 23*a*, 24*a* having a diameter of approximately 25 mm, tip areas 23*b*, 24*b* having a diameter of approximately 15 mm, and are attached to the rear part of the cassette base 27. The central cushion element 25 has a base diameter E of approximately 12 mm, a tip diameter e of approximately 7 mm, and is connected in the middle of, or in between, the first and second set of cushion elements. The first and second sets of cushion elements have slightly different base and tip diameters to accommodate the taper or angle of the heel of the foot. Consequently, the slightly larger-diameter first set of cushion elements 21, 22 are located closest to the forefoot area, and the second set of slightly narrower-diameter cushion elements 23, 24 are located closest to the rear of the shoe.

As best shown in FIG. 2A, the cassette base 27 has a generally ovoid shape that conforms to the base portions 21*a*–24*a* of the first and second sets of cushion elements. The cassette base has a length A of approximately 56 mm, a length B of about 53mm and a length C of about 51 mm. Of course, the cassette base measurements A, B and C could be larger or smaller depending on the shoe heel size and other design choices. In the embodiment shown in FIG. 2B, the cassette base 27 and the first and second sets of cushion elements are each approximately 6 mm thick so that, at its thickest point, the shock absorbing cassette is about 12 mm thick. The central cushion element 25 is approximately 4 mm thick.

The shock absorbing cassette 20 is only 12 mm thick to minimize the overall thickness of the shoe heel. A thin sole is important for skateboarders, enabling them to receive "board feel" through the soles of their shoes to their feet. This "board feel" enables the skateboarder to better control the skateboard. However, the shock absorbing cassette 20 may be in the range of 8 mm to 16 mm thick depending on expected use. For example, to increase board feel at the expense of some cushioning and some durability, a professional skateboarder may opt for a shoe having a cassette that is only 8 mm thick, while a novice who wants more cushioning and durability would choose a shoe having a thicker shock-absorbing cassette.

Figure 4:
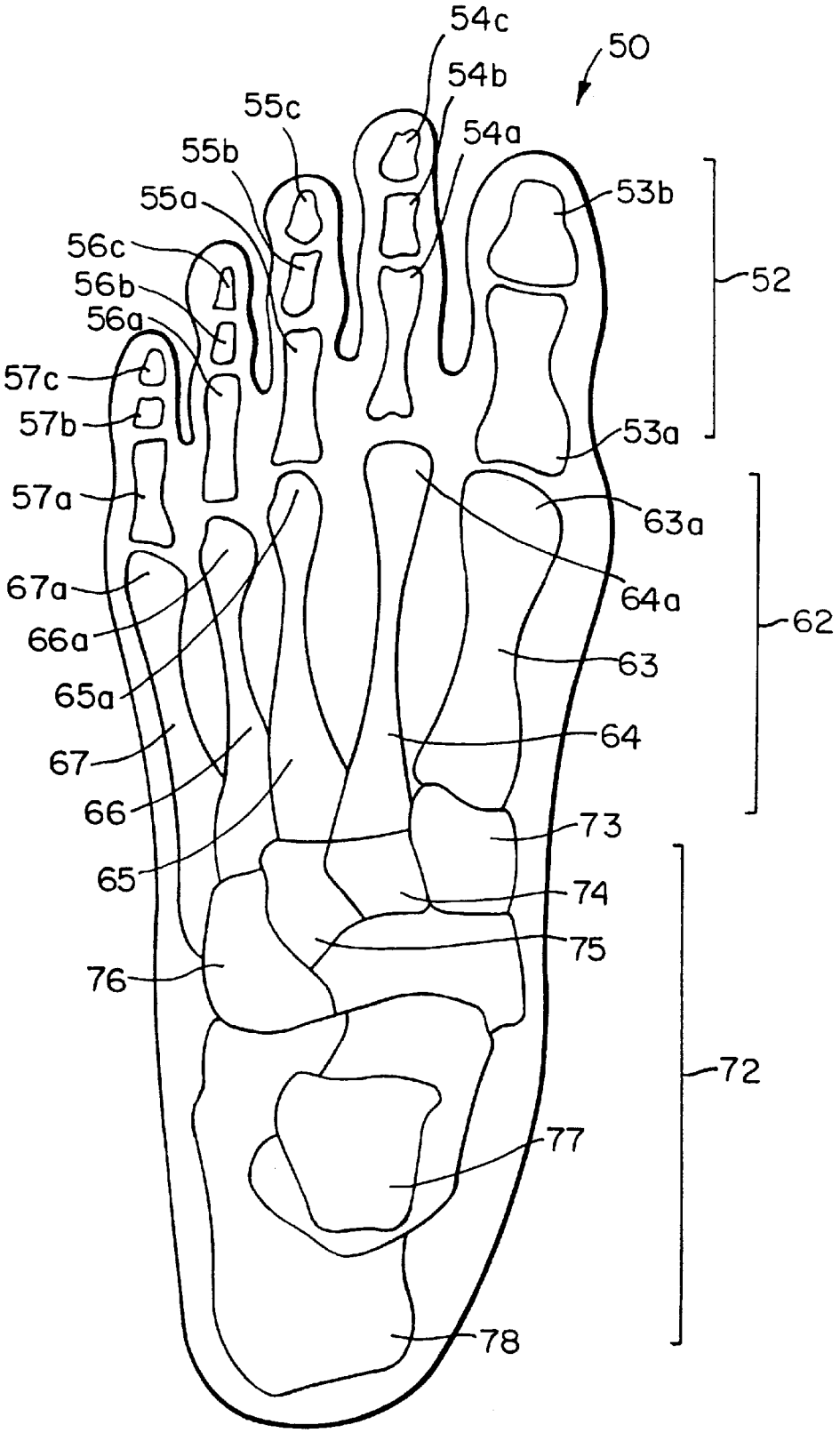
FIG. 4 is a representation of the skeletal framework of the human foot.

Referring to FIGS. 2A, 1B and 4, the five cushion elements 21–25 of the shock absorbing cassette 20 are strategically arranged to support the heel bone, or calcaneus bone 78. It has been determined that the base diameters of the first and second sets of cushion elements 21, 22 and 23,24 should be as large as possible within the confines of the cassette base 27 to provide the best possible cushioning characteristics, because the first and second sets of cushioning elements function to distribute the initial force from impact of the shoe sole to the outside edges of the heel bone. After initial impact, the central cushion element 25 contacts the outsole and compresses to provide cushioning for the center of the heel bone 78. Consequently, each of the five cushion elements compress to cushion and/or damp the impact. The dual shock-absorbing capability of this dual suspension system provides improved cushioning for the heel of a wearer to prevent heel bruising.

A computerized gravity driven impact tester was used to provide deformation data of a shoe containing the shock-absorbing cassette 20. The system conforms to ASTM standards for footwear, and the test method was based on peak forces during heel strike. The test results showed that a shoe incorporating the shock-absorbing cassette 20 performed well in absorbing shock, and returned between 42 and 45 percent of the energy from the heel strike to the foot.

Figure 2C:
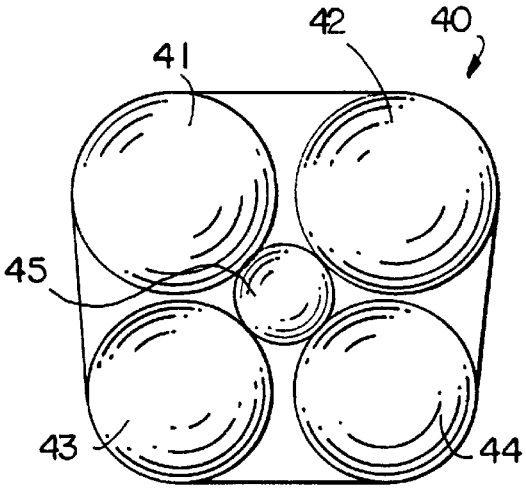
FIGS. 2C and 2D are top and side views, respectively, of an alternate embodiment of a shock absorbing cassette.
Figure 2D:
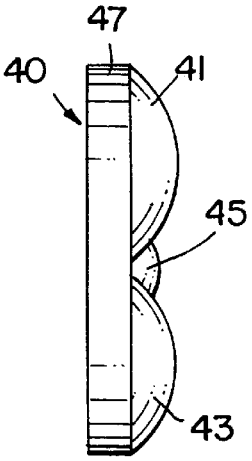

FIGS. 2C and 2D are top and side views of an alternate embodiment of a shock absorbing cassette 40 having five cushion elements 41–45. A first and second set of cushion elements 41, 42 and 43, 44, and a reduced-height cushion element 45 are hemispherically-shaped and are attached to a cassette base 47. The shock absorbing cassette 40 is similar in structure to the cassette 20 of FIG. 2A in that the two sets of cushion elements are arranged about the cassette base 47 to cushion the heel bone, and the smaller central cushion element 45 is connected to the cassette base 47 in between the other four cushion elements. However, the spheres 41–45 are not truncated, rather being rounded at the tip. When heel impact occurs, the outside sets of cushion elements act first to absorb the shock and then the central cushion element compresses a short time later. This dual shock-absorbing system provides enhanced heel shock absorption to help minimize heel bruising.

Figure 2E:
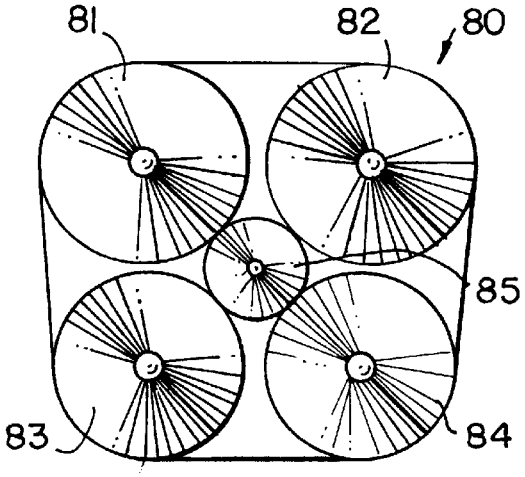
FIGS. 2E and 2F are top and side views, respectively, of another embodiment of a shock absorbing cassette.
Figure 2F:
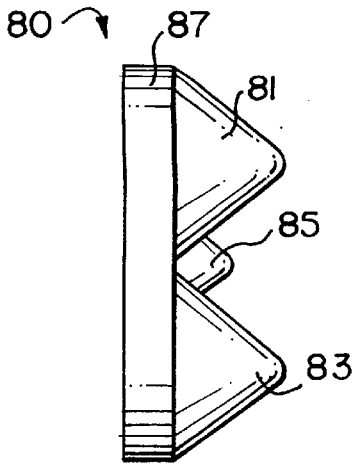

FIGS. 2E and 2F are top and side views of another alternate embodiment of a shock-absorbing cassette 80 have five cushion elements 81–85. The cushion elements are generally conically-shaped and are attached to the cassette base 87. As shown, the first set of cushion elements 81, 82 and the second set of cushion elements 83, 84 are thicker than the cassette base 87. As explained above, the thickness of the overall shock absorbing cassette 80, and each of the various components of the cassette, is a matter of design choice.

Figure 2G:
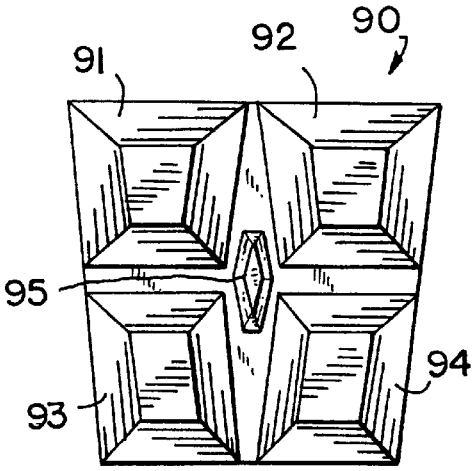
FIGS. 2G and 2H are top and side views, respectively, of yet another embodiment of a shock absorbing cassette.
Figure 2H:
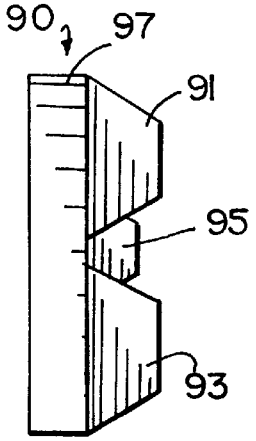

FIGS. 2G and 2H are top and side views of yet another alternate embodiment of a shock-absorbing cassette 90 having five cushion elements 91–95. A first set of cushion elements 91, 92 and a second set of cushion elements 93, 94 are generally trapezoid-shaped, whereas a reduced-height cushion element 95 has a generally diamond-shape. As best seen in FIG. 2G, the cassette base 97 has a trapezoidal shape, with sharp rather than rounded corners, to conform to the edges of the first and second set of cushion elements. As shown in FIG. 2H, the cassette base 97 is also thinner than the first and second sets of cushion elements 91, 92 and 93, 94, but this is a matter of design choice as explained above.

In general, it has been found that geometric shapes that have larger bases and smaller tips are best suited for use as cushioning elements. Combined with their positions on the cassette base, the cushion elements improve the shock damping ability of the shoe. The tip of each cushion element contacts the outsole during impact, and the decrease in mass (in comparison to other shaped cushion elements, such as a cylinder) results in less compression force and therefore a more controlled damping of the shock. In other words, the smaller tips of the cushion elements more readily compress to provide an enhanced damping effect, and the elements cradle the heel bone as force is applied.

It will be apparent to one of skill in the art that other shapes could be used to form the cushion elements, and that the cassette base could similarly be modified to achieve desired cushioning and damping effects. However, it is preferred that the wider-diameter or base of the cushion elements be attached to the cassette base, so that the tip of each cushion element first contact the outsole on impact. This is an important consideration for a skateboarder, because such positioning of the cushion elements placement provides both a controlled damping effect and cushioning to prevent heel bruising. The damping effect ensures that the shoe does not rebound to a great extent on impact, which is important to a skateboarder striving to remain in control when landing on the skateboard or other surface after a jump maneuver. However, some or all of the tips of the cushion elements could be oriented to face the cassette base to provide slightly different shock dispersion characteristics.

The heel shock absorbing cassettes 20, 40, 80 and 90 are suitably made of polyurethane, but other cushioning materials could be used. For the sport of skateboarding, it has been found that a polyurethane having a density in the range of 57 to 63 durometers is ideal, wherein a durometer is a measure of the density of a material known to those skilled in the art. However, the density of the polyurethane can be increased or decreased to provide more or less cushioning. The trade-off when using a less dense material to gain more cushioning is a slight loss of foot control for a skateboarder. However, if less cushioning is desired, then the polyurethane used in forming the cassette may be in the range of 65±3 durometers to provide a denser material.

The shock absorbing cassette can be manufactured in one piece of the same material. For example, a mold could be used to manufacture a unitary polyurethane shock absorbing cassette. Alternately, the base and cushion elements could be separately manufactured and then attached together. This alternate method is advantageous if the cushion elements are to be made of a different density polyurethane than the base element, or of different materials such as Sorbathane™.

Figure 3A:
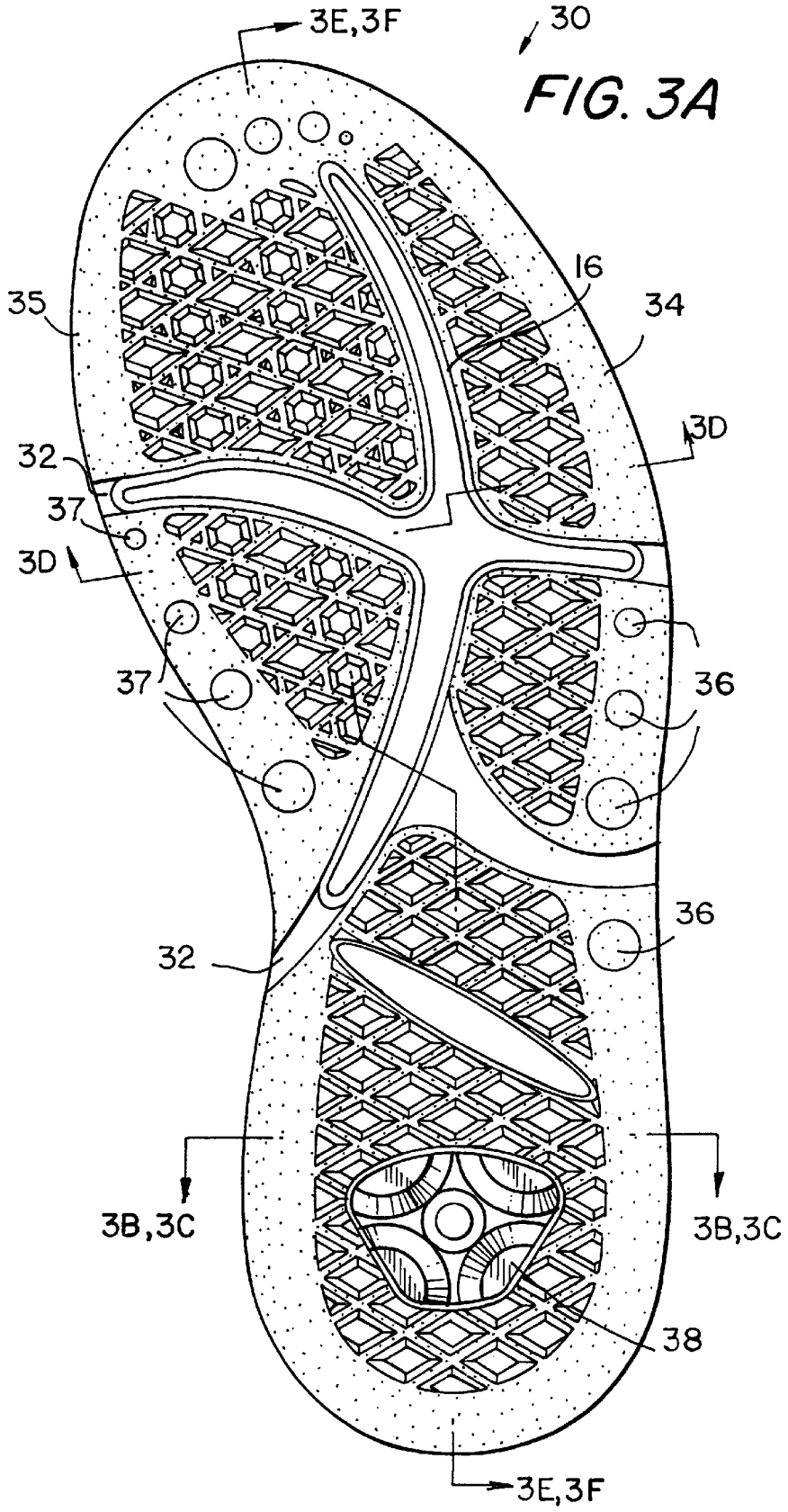
FIG. 3A is a bottom plan view of the sole shown in FIG. 1A.

FIG. 3A is a top view of the outsole 30 shown attached to the midsole 10 (see FIG. 1B). The outsole is made of a durable rubber with a high "NBS" rating, which is a rubber durability rating. The outsole has a generally smooth, curved lateral side outside edge 34, and a generally smooth, curved medial outside edge 35. Also shown are a series of lateral cup units 36 and medial cup units 37 which are useful for traction. A translucent window 38 in the heel area may also be provided so that a consumer may view the cassette 20 of FIG. 2A when purchasing the shoe.

Figure 3B:
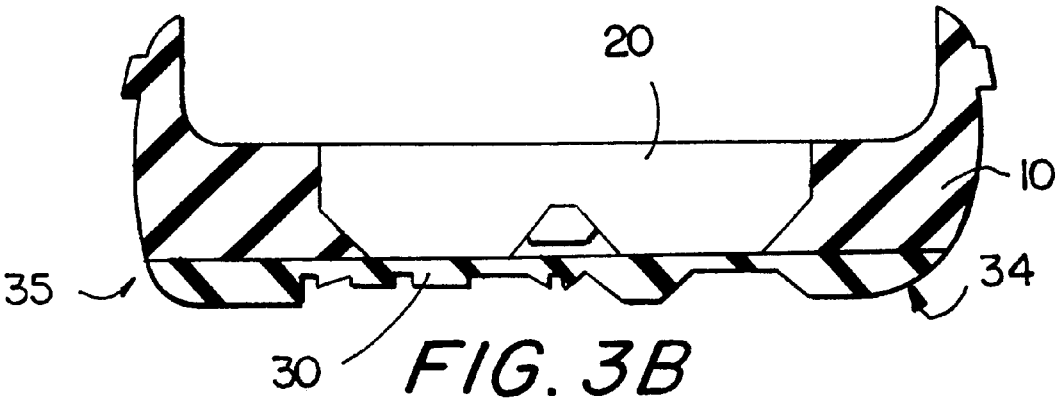
FIGS. 3B and 3C are cross-sectional views of the sole of FIG. 3A taken along line 1—1 with alternate embodiments of shock absorbing cassettes contained therein.

FIG. 3B is a cross-sectional area of the sole 2 taken along line 1—1 of FIG. 3A. Shown are the midsole 10, shock absorbing cassette 20 and outsole 30. The outsole is between about 2 and 5 mm thick, and the shock absorbing cassette is approximately 12 mm thick, so that the thickness of the heel area of the sole 2 is between 14 and 17 mm. However, the outsole may be made somewhat thicker to improve durability. This compares to a heel sole thickness of up to 25 mm for some running shoes. In addition, it should be noted that the heel pocket 18 (see FIG. 1B) of the midsole conforms to the edges of the cassette base 27, and thus to the edges of the cushion elements 21–24, which improves bonding of the cassette and midsole. A good fit of the cassette within the midsole ensures that the cassette will not become dislodged during use.

Figure 3C:
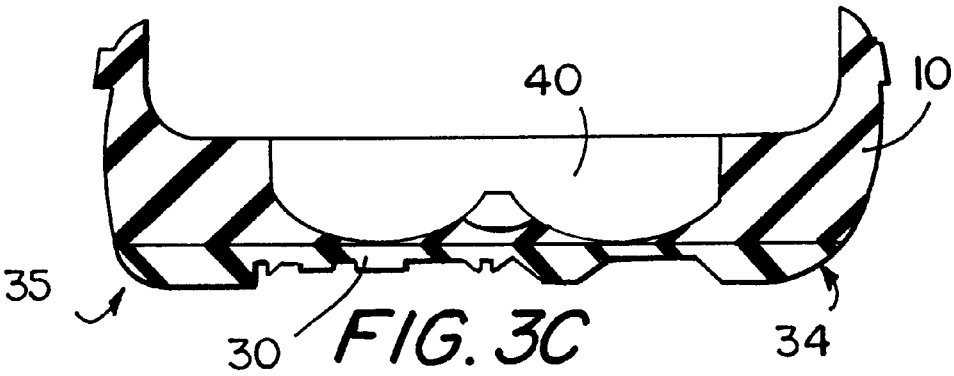

FIG. 3C is a cross-sectional area of the sole 2 taken along line 1—1 of FIG. 3A with the alternate embodiment shock-absorbing cassette 40 installed therein. The dimensions of the outsole 30, cassette 40 and heel area of the sole 2 are comparable to that described above with respect to FIG. 3B. In addition, as described above, the heel pocket 18 of the midsole 10 conforms to the edges of the cassette base 47 and cushion elements 41–44 to ensure a good fit.

Referring to FIGS. 3B and 3C, the curvature of the lateral outside edge 34 has a radius of 12.0 degrees, while the curvature of the medial outside edge 35 is 6.0 degrees. The larger curvature on the lateral outside edge 34, which may be continued along the outside portion of midsole 10, permits a skateboard rider to maintain control for a longer period of time as he rolls his foot outwardly on the skateboard during maneuvers. Although a lateral outside curvature of 12.0 degrees is specified, a smaller or larger curvature could be used. In general, the lateral outside curvature may suitably be 7.0 to 18.0 degrees. The inside edge curvature of 6.0 degrees is typical of most athletic shoes, and is adequate because there is less leverage effect, or rolling of the foot to the medial side. Of course, a larger or smaller curvature could be used on the medial edge as well.

Figure 3D:
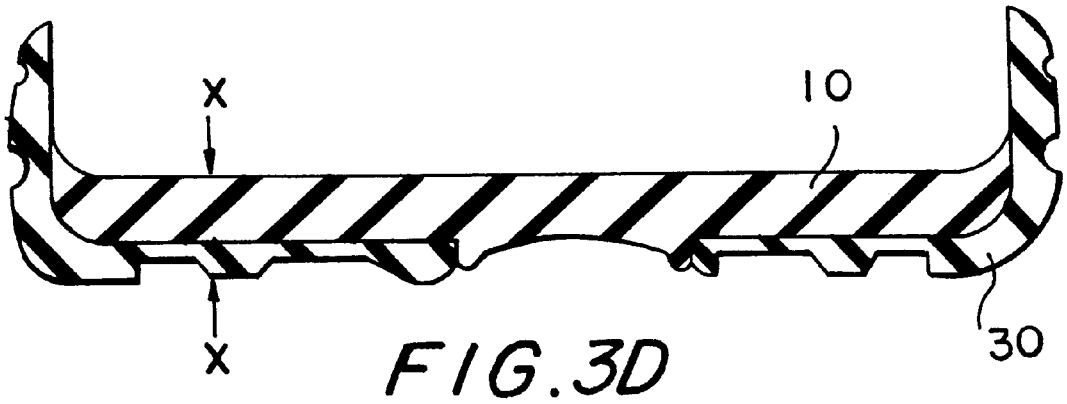
FIG. 3D is a cross-sectional area of the sole of FIG. 3A taken along line 2—2.

FIG. 3D is a cross-sectional view taken along line 2—2 of FIG. 3A in the forefoot area of the sole 2. In this area, the thickness of the midsole 10 is approximately 6 mm, and the thickest part of the outsole 30 is approximately 4 mm. Thus, the thickest part of the outsole in the forefoot area, for example between arrows x—x, is approximately 10 mm, although if a thicker outsole is used this measurement may be in the range of 10 mm to 15 mm. A thin forefoot sole area enables a skateboard rider to get a "feel" for the skateboard, and permits the shoe sole to flex easily as the rider changes positions and performs maneuvers on the skateboard. The thinness of the sole in the forefoot area in combination with the channel 32 and the forefoot slits 9 on the insole board 8 permits the shoe sole to more easily bend as the metatarsal heads 63*a*–67*a* of the metatarsus bones 62 (see FIG. 4) flex during movement of the foot. This is important because a correlation has been observed between forefoot flexibility in a shoe sole and heel cushioning. In particular, it appears that a flexible forefoot sole section that permits the foot to flex naturally also promotes the correct positioning of the heel within the shoe. Consequently, when a skateboarder is about to impact a surface, his heel is positioned correctly within the shoe to gain the full benefit of the heel shock absorbing cassette.

Figure 3E:
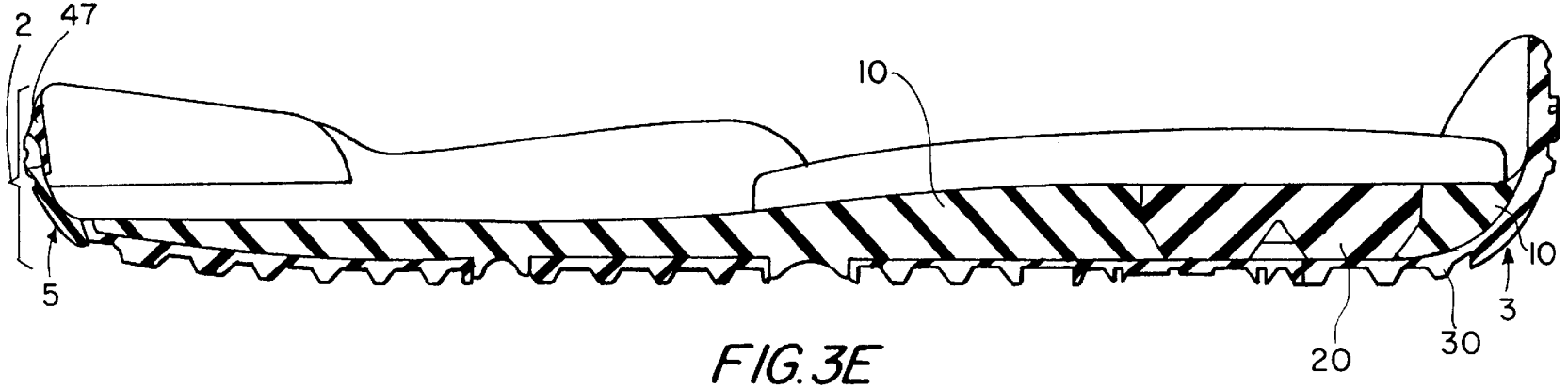
FIGS. 3E and 3F are cross-sectional views of the sole of FIG. 3A taken along line 3—3 with alternate embodiments of shock absorbing cassettes contained therein.
Figure 3F:
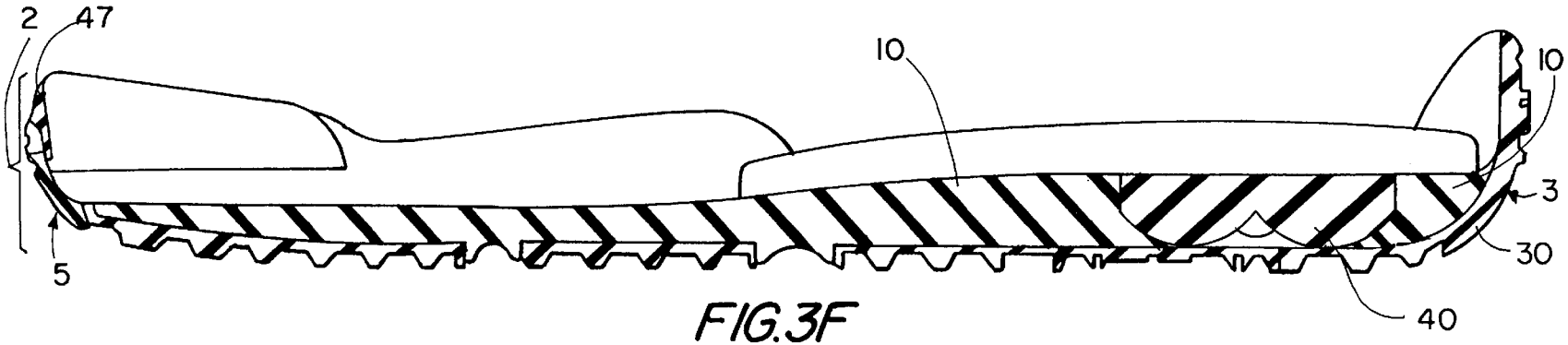

FIGS. 3E and 3F are cross-sectional views taken along line 3—3 of FIG. 3A to illustrate the various layers that make up the sole 2, where FIG. 3E contains the shock-absorbing cassette 20 and FIG. 3F contains the shock-absorbing cassette 40. As shown in both FIGS. 3E and 3F, the midsole 10 is thickest in the heel area in the vicinity of the shock absorbing cassettes 20 and 40, and becomes thinner as it approaches the toe area 5. The outsole 30 varies between 2–5 mm along the length of the sole. The curvature of the outsole at the rear portion 3 of the shoe is approximately 25 degrees, and the curvature in the toe area is approximately 45 degrees. The rear and toe curvatures were chosen to permit a smooth transition when a skateboarder performs a "toe off" or "heel roll" motion, but more or less curvature could be utilized.

A toe guard 47 is also provided, made of a durable rubber material, to protect the upper material of the skateboard shoe from premature wear. The toe guard is necessary because of certain maneuvers performed by skateboard riders that involve dragging or scrapping the toe area of the shoe on pavement or on the skateboard itself.

Numerous characteristics, advantages, and embodiments of the invention have been described in the foregoing description with reference to the accompanying drawings.

However, the disclosure is illustrative only and various changes and modifications may be effected by one skilled in the art without departing from the scope or spirit of the invention. For example, the shock absorbing cassette and/or the cushion elements could be larger or smaller than that described, depending on the amount of cushioning and rebound desired. In addition, the tip of at least one of the cushion elements may be attached to the cassette base portion.

What is claimed is:

1. A shock absorbing cassette for the midsole of an article of footwear, comprising:

a cassette base;

a first set of deformable cushion elements, wherein each cushion element has a wide base and a narrower tip, attached to a front portion of the cassette base;

a second set of deformable cushion elements, wherein each cushion element has a wide base and a narrower tip, attached to a rear portion of the cassette base; and at least one reduced height cushion element that is shorter than at least one cushion element of either the first or second set of cushion elements, and that has a base that is smaller than the base of any of the first and second sets of cushion elements and has a narrower tip and is attached to the cassette base in between the first and second sets of cushion elements.

2. The shock absorbing cassette of claim 1, wherein the cushion elements are in the shape of truncated cones.

3. The shock absorbing cassette of claim 1, wherein the cushion elements are hemispherically shaped.

4. The shock absorbing cassette of claim 1, wherein the first and second sets of cushion elements are of equal height.

5. The shock absorbing cassette of claim 1, wherein the base of each element of the first set of cushion elements is larger than the base of each element of the second set of cushion elements.

6. The shock absorbing cassette of claim 1, wherein the base of each of the first, second and reduced height cushion elements is attached to the cassette base portion.

7. The shock absorbing cassette of claim 1, wherein the tip of at least one of the cushion elements is attached to the cassette base portion.

8. A method for manufacturing a shock absorbing cassette for an article of footwear, comprising:

forming a cassette base having a front area and a rear area;

forming a first set of cushion elements, wherein each cushion element has a base and a narrower tip;

forming a second set of cushion elements, wherein each cushion element has a base and a narrower tip;

forming a reduced height cushion element that is shorter than at least one cushion element of either the first or second set of cushion elements, the reduced height cushion element having a base that is smaller than the base of any of the first set and second set of cushion elements and having a narrower tip; and attaching the first set of cushion elements to the front area of the cassette base, the second set of cushion elements to the rear area of the cassette base and the reduced height cushion element to the cassette base in between the first and second sets of cushion elements.

9. The method of claim 8, wherein the cassette base is made of polyurethane.

10. The method of claim 9, wherein the polyurethane is in the range of 57 to 68 durometers.

11. The method of claim 8, wherein the cushion elements are made of polyurethane.

12. The method of claim 11, wherein the density of the polyurethane is in the range of 57 to 68 durometers.

13. A method for manufacturing a shock absorbing system for an article of footwear, comprising:

forming an insole board having a plurality of forefoot slits;

forming a midsole of cushioning material having a thin forefoot section and a heel pocket;

forming a shock absorbing cassette having a cassette base and a first plurality of cushioning elements connected to a front portion of the cassette base, a second plurality of cushion elements connected to a rear portion of the cassette base, and at least one reduced height cushion element connected between, and shorter than at least one of, the first and second plurality of cushion elements, each cushioning element having a base and a narrower tip, wherein the base of the reduced height cushioning element is smaller than the base of any of the first and second sets of cushion elements;

connecting the midsole to the insole board and seating the shock absorbing cassette in the heel pocket; and attaching a flexible outsole to the midsole and shock absorbing cassette.

14. The method of claim 13, wherein the cassette is formed so that the tips of the cushioning elements face away from the cassette base.

15. The method of claim 13, wherein the cassette is formed so that at least one of the tips of the cushioning elements face the cassette base.

16. The method of claim 13, wherein the midsole cushioning material is CMEVA.

17. The method of claim 13, wherein the heel pocket is shaped to conform to the shape of the shock absorbing cassette.

18. The method of claim 13, wherein the insole board contains heel cuts.

19. A shock absorbing system for a shoe, comprising:

a midsole having a thin forefoot section and a heel pocket;

a shock absorbing cassette comprising a cassette base, a first plurality of cushion elements connected to a front portion of the base, a second plurality of cushion elements connected to a rear portion of the base, and a reduced height cushion element, wherein each cushioning element has a base and a narrower tip, and wherein the reduced height cushion element is shorter than at least one of the first or second plurality of cushion elements, has a base that is smaller than any of the first and second sets of cushion elements, and is connected to a central portion of the cassette base, the cassette seated in the heel pocket; and a flexible outsole connected to the midsole, wherein the outsole includes a toe area and a heel portion, and includes a curved lateral outside edge.

20. The system of claim 19, further comprising a toe guard attached to the outsole.

21. The system of claim 19, further comprising an insole board connected to the midsole that contains a plurality of heel cuts.

22. The system of claim 19, wherein the lateral outside edge has a curvature in the range of 7.0 to 18.0 degrees.

23. The system of claim 19, wherein the heel portion has a curvature of 25 degrees.

24. The system of claim 19, wherein the toe area has a curvature of 45 degrees.

25. The system of claim 19, further comprising an insole board having forefoot slits connected to the midsole.

* * * * *